United States Patent [19]

Yonehana et al.

[11] Patent Number: 4,561,473

[45] Date of Patent: Dec. 31, 1985

[54] DOUBLE-PILE LOOM

[75] Inventors: Kiyoshi Yonehana; Zenpei Tachibana, both of Kyoto, Japan

[73] Assignees: Kawashima Textile Manufacturers Ltd.; Kyocera Corporation, both of Japan

[21] Appl. No.: 607,816

[22] Filed: May 7, 1984

[30] Foreign Application Priority Data

Jul. 30, 1983 [JP] Japan ..... 58-102595[U]

[51] Int. Cl.[4] ..... D03D 39/18

[52] U.S. Cl. ..... 139/21; 30/345; 139/291 C

[58] Field of Search ..... 139/21, 22, 291 C; 358/299; 96/DIG. 12; 26/13; 30/345, 346.53, 346.54, 350

[56] References Cited

U.S. PATENT DOCUMENTS 4,357,633 11/1982 Buechler ..... 358/299

*Primary Examiner*—Henry S. Jaudon

*Attorney, Agent, or Firm*—Darby & Darby

[57] ABSTRACT

A cutter for a double-pile loom which cutter is fixed to a slider to slide on a rail in parallel with the cloth fell. The cutter is adapted to reciprocate crosswise in the space between the top and bottom sheets of fabric synchronously with picking to cut the pile yarns which stitch together two sheets of fabric to form piles. The cutter edge is made of a single crystal sapphire and is highly resistant to wear having its cutting characteristics maintained for a long term. Grindstones are not needed to maintain a sharpness of the cutter.

6 Claims, 9 Drawing Figures

7'
8'
9
1
11
2
5
6
8
4
7
12
3
2
5 a
18
15
11
9
d
l
13'
18
1
14
4
3
2
12
15
10
13
14
19
b
19

16
4
17
8
3
7
17
2
16'

17
7 (8)

DOUBLE-PILE LOOM

BACKGROUND OF THE INVENTION

This invention relates to a cutter for use in a double-pile loom.

In a double-pile loom, the top and the bottom ground fabrics are doubly woven and pile yarns are inserted therein. When these pile yarns are cut at the rear of the cloth fell and turned into piles, two separate cut warp pile fabric are simultaneously produced.

These kinds of pile fabrics are called wilton, moquette, velvet, plush etc.

As in an ordinary loom such as a plain-loom, the double-pile loom is comprised of warpletting-off apparatus, shedding apparatus, weft inserting apparatus, beeting apparatus, taking-up apparatus and so on.

However the double-pile loom is different from ordinary looms for weaving cotton or woolen fabric since it includes a pile cutting apparatus.

As regards the fabric woven by the ordinary loom, the appearance of a woven texture composed of warps and wefts intersecting each other is a decisive factor for determining the commercial value of the fabric. An uneven weft density or skew (wefts running not straight) is regarded as a defect.

In a pile fabric, woven texture composed of warps and wefts intersecting esch other are not apparent on the right side of the fabric and less influential upon the commercial value thereof but, instead, smoothness (evenness) of the pile-covered surface is an important factor decisive to the commercial value thereof. Roughness of this surface caused by pile lengh difference is considered a defect.

The degree of smoothness of pile-covered surface depends on whether the cutting apparatus operates regularly or not.

A cutting apparatus known in the prior art, has the structure as shown in FIGS. 1 through 4.

In the drawings, the reference numerals 18 and 19 indicate the ground texture of the top and the bottom fabrics composed of warps and wefts. The numeral 14 indicates pile yarns which are woven into the structure so as to stitch the ground texture 18 and 19 of the top and the bottom fabrics to each other. The numerals 2 and 3 indicate a rail supported in parallel with the cloth fell and a slider sliding on the rail 2 and provided with a cutter 4, respectively. The slider is driven to reciprocate in the space between the top and the bottom ground textures 18 and 19, respectively, by a drum 6, which turns in the right and the reverse directions synchronously with a picking motion, via rope 5.

The cutter edge 13 cuts a multitude of pile yarns 14 woven into the texture and stitching the top and the bottom ground textures 18 and 19, respectively, and arranged in a line weftwise for formation of piles 15 in line weftwise. At the same time, the ground textures 18 and 19 are separated from each other above and below. Two cut warp pile fabrics are thus formed—the top fabric 11 with the pile-covered surface on the lower side, and the bottom fabric 12 with a similar pile-covered surface on the upper side.

The numerals 9 and 10 denote stationary platelike blocks called scale for preventing the top and the bottom ground textures 18 and 19, respectively, from vibrating while the cutter 4 travels.

Usually, the number of pile yarns lined weftwise reaches thousands and the cutter edge 13 to cut these yarns in single stroke is susceptible to wear. As a countermeasure to such wear as above, a pair of grindstones 7 and 8 (7' and 8') directed upward and downward, respectively, are disposed near both edges of the fabric and energized by springs 16 (16') so that the obverse and the reverse sides of the running cutter edge 13 are ground by the grindstones during every reciprocation thereof.

To grind the cutter edge at a fixed angle from end to end thereof, grindstones 7 and 8 (7' and 8') must be under a fixed uniform pressure while touching the cutter edge from end to end thereof.

In other words, grindstones must be positioned and mounted on the loom so that the cutter edge is in point-contact with the grindstones under a fixed pressure. The grindstones surface in contact with the cutter edge must be curved in the lengthwise direction like the surface of a cone but straight in the transverse derection at any position from end to end thereof along the cutter running direction, and these conditions must be invariably maintained.

Such, performance however, is possible in theory but extremely difficult in practice.

Such problems as above involved in the prior art are summarized as follows:

(1) Pressing action by the weight of the downward directed grindstone 8 upon the cutter edge 13 is strong whereas that by the upward directed one 7 is weak. Accordingly, in consideration of the weight of the grindstones, the force of a spring 16 for the downward directed grindstone 7 and that of another spring 16' for the upward directed grindstone 8 must be weak and strong, respectively, for pressing both grindstones to the cutter edge 13 with the same degree of pressure. However, designing spring 16 and 16' to meet such requirement is difficult. Thus the cutter edge gradually varies in the shape while used such that, the obverse and the reverse sides (upside and downside) of the cutting edge lose angular therebetween, and a pile length difference is caused between both sheets of fabric in such a way that the pile length a of the fabric on one side to which the cutter edge is deviated is short whereas pile length b on the other side is long. Although the fabric having long piles can be correctly finished by shearing and adapted to conform to the standard, that having short piles cannot but be disposed of as rejected.

(2) By adjusting the positions of the scales 9 and 10 in the vertical direction for setting a path on which the cutter edge 13 runs at a middle position between the top fabric 11 and the bottom fabric 12, an inferior product having a length difference between piles 15 of the top fabric 11 and the bottom fabric 12 is prevented. However, such adjustment if performed every time required, gradually cause the middle position between the top fabric 11 and the bottom one 12 to deviate. In this case, a new cutter edge replacing the old one runs on an unexpected course, whereby a large pile length difference is caused between the top and the bottom fabrics, and a sharp step appear on the pile-covered surface of either sheet of the fabric correspondingly to the time of the replacement of cutter edge. Above all, in the case of moquette, since the pile length thereof a (b) is usually as short as 2 to 3 mm, the cutter edge, when deviated, may possibly eat into the ground texture 18 (19) on one side and produce an un-repairable defect.

(3) The cutter gradually becomes short since the edge thereof is always subjected to grinding by the grindstones. The edge 13' of a new cutter replacing the old one is located close to the cloth fell in length d anticipated to be worn out. Accordingly, althought one row of pile yarns lined weftwise will have been cut by one stroke of the cutter, two or more rows are unreasonably cut immediately after the replacement of cutters. Variation in cutting conditions as above causes a defect called weftwise streak on the pile-covered surface.

(4) Grindstones 7 and 8 are liable to be subjected to strong pressing to the cutter edge 13 due to the user's desire to obtain sharp cutting, however, extremely strong pressing causes the cutter edge 13 to be too sharp and prouce a burr on the edge 13, thereby reducing cutting ability. Moreover, the cutter edge thus deteriorated tears the pile yarns and causes an un-repairable hairy surface.

(5) A step-like rubbing mark gradually appears on the grindstones at the part rubbed by the cutter edge. When the cutter is replaced and positionally adjusted without replacing the transformed grindstones, transformation of the cutter edge, above all burr, is expedited. Therefore, even when either a cutter or a grindstone is worn and transformed, both of them must be replaced, or ground and adjusted correctly. However, grinding and adjustment of the worn grindstones requires a considerable level of skill and, in many cases, the worn grindstone is must be replaced by a new one.

(6) In the case of the fabric of high pile-density such as moquette, a pile length difference as small as 0.1 mm is regarded as a defect known as a stepped surface. Adjustment of the scales 9 and 10, grindstones 7 and 8, and cutter edge 13 requires a high level of skill and a considerable length of time. Further, as a matter of practice, the cutter edge must be ground and adjusted at intervals of about 30 min. during weaving. Therefore, the conventional cutting apparatus makes complete automation of the double-pile loom impossible, leaving the loom at a markedly low level of productivity.

(7) Trial operation is required after fine adjustment of the replaced cutter or grindstones and inevitably causes clumsily cut yarn.

(8) As described above, a step-like mark resulting from pile length difference as small as 0.1 mm is distinguished as a defect and this defect is inevitable even if a considerably high level of skill is applied to operation. Therefore, according to the prior art, the fabric is woven so as to be provided with piles slightly longer than those to be obtained in the finals in consideration of occurrence of such defect as above and then the piles are evenly cut by shearing to be conformable to the standard length.

Usually, the tip of pile in length as 0.3 to 0.6 mm is cut away by shearing. However, removal as much as 0.3 to 0.6 mm from the pile length of the short-pile fabric such as a moquette which ranges from 2 to 3 mm corresponds to a 15 or more percent loss of pile yarn. And, the pile yarn costs far higher than the warp and the weft yarns for the ground texture. Thus, loss of yarn in the shearing process adds greatly to the cost of products.

SUMMARY OF THE INVENTION

A first object of the present invention is to provide a double-pile loom of high operational efficiency which requires no adjustment in setting the cutter and the grindstone.

A second object of the present invention is to provide a double-pile loom not causing pile length difference between the top and the bottom sheets of pile fabric, breakage of the ground texture, weftwise streak on account of variation in cutting conditions, fuzzing on the pile-covered surface, and defects such as step-like mark on the pile-covered surface which may otherwise be caused in the trial operation thereof.

A third object of the present invention is to reduce the loss of pile yarns resulting from pile length difference between the top and the bottom sheets of pile fabric, breakage of the ground texture, weftwise streak resulting from variation in pile yarn cutting condition, fuzzing on the pile-covered surface, and step mark on the pile-covered surface caused in the trial operation of the loom.

A fourth object of the present invention is to economically provide a pile fabric of superior quality free from defects.

To fulfil the above objects, the inventors of the present invention have completed this invention after strenuous study and research into time loss in setting and adjusting the cutter and the grindstone as well as loss of pile yarns, apart from the conventional fixed concept of setting grindstones on the double-pile loom and of grinding the cutter during each reciprocation of the cutter.

The present invention comprises a cutter edge of single crystal sapphire, the cutter being used on the double-pile loom, fixed to a slider to slide on the rail in parallel with the cloth fell, and adapted to reciprocate crosswise in the space between the top and the bottom sheets of fabric synchronously with picking so as to cut pile yarns which stitch together the abovesaid two sheets of fabric for formation of piles.

A double-pile loom according to the present invention is characterized in that, first, none of grindstone to grind the cutter edge is provided therefor.

A second feature of the present invention is that single crystal sapphire in the shape of a sheet as thick as 0.4 mm is used as a cutter and a part of the periphery thereof is shaped arcuate and formed into an edge having an angle in the range of 5° to 31°.

Other objects and feature of the present invention will become more apparent from the following description and accompanying drawings.

DETAILED DESCRIPTION OF THE INVENTION

According to this invention, a cutter edge to cut pile yarns is made of single crystal sapphire, and a grindstone to grind the cutter edge is not used.

The cutter may be in the shape of disk, in other words, may be a single crystal sapphire disk having a cutting edge at the entire periphery thereof. The cutter can be fixed to the slider after being bonded to a metal plate.

Single crystal sapphire is colorless and transparent, having characteristics such as specific gravity of 3.97, hardness of 2,300 kg/mm$^2$ in Vickers number, bending strength of 7,000 kg/cm$^2$, compression strength of 30,000 kg/cm$^2$, Young's modulus of 4,800,000 kg/cm$^2$, specific heat of 0.18 cal/g ° C., which are without match among other mateials used in the conventional cutter in respect of mechanical strength, resistance to heat, anti-corrosiveness, resistance to chemical agents and resistance to wear.

In this way, single crystal sapphire used in the cutter according to the present invention is remarkably high in hardness, bending strength, resistance to corrosion, resistance to wear and so on, whereby too small degree of angle at the cutter edge is not proper and, at the same time, increased degree of angle is also not proper because cutting characteristic is decreased through the strength of the edge is increased.

From experiments in which cutters were prepared in such a way that the angle of cutter edge was varied very two degrees within the range from 5° to 31°, it was found important to fix the edge angle with in the range from 7° to 27°, preferably from 11° to 23°, for maintaining satisfactory cutting characteristics in the light of breakage of the cutter edge and eveness of the pile-covered surface.

Experiments on cutter edges made for trail with respect to meter ials thereof reveals that zerconia and alumina ceramics are not suitable since the pile-covered surface is not finished smooth.

A thin cutter vibrates during running and causes the pile-covered surface to be uneven. A thick cutter, on the other hand, is not suitable because of the difficulty in providing the edge therefor and the increase in resistance of pile yarns exerted thereto during movement.

As a trial, a 0.4 mm thick single crystal sapphire sheet cutter have an edge angle of 19° was used for weaving moquette with pile yarns of nylon which have hitherto to been liable to be a cause of unsatisfactory cutting, from it was confirmed that the cutting characteristic of the cutter was kept high even after weaving of about 40 pieces (each 50 meter long) of moquette.

Now, embodiments of the present invention wil be described.

Figure 1:
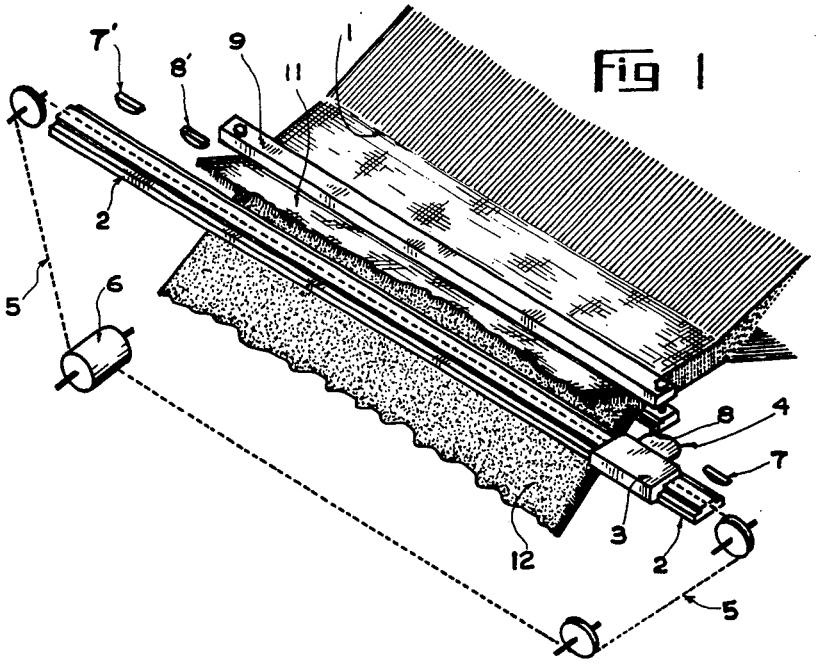
FIG. 1 is a perspective view of a cutting apparatus on the conventional type double-pile loom.
Figure 2:
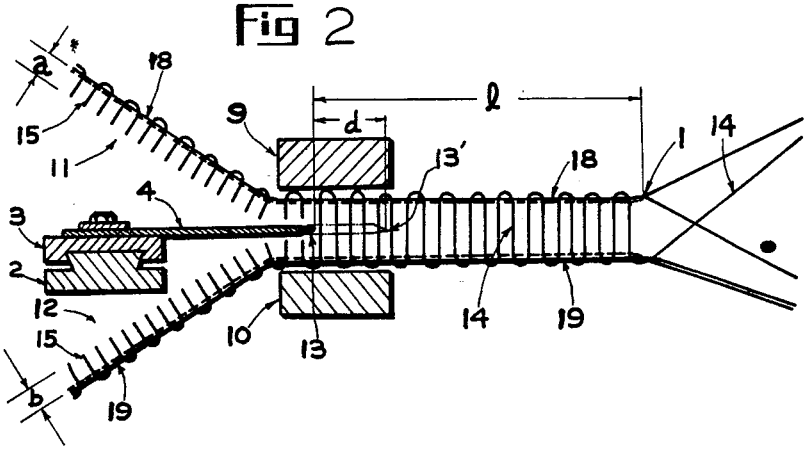
FIG. 2 is a sectional view of a cutting apparatus taken at a yarn cutting position.
Figure 3:
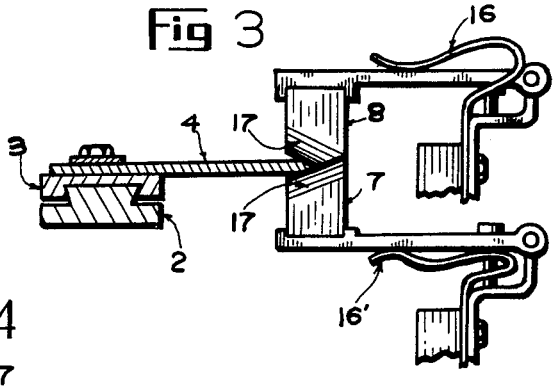
FIG. 3 is a partially sectional side view of the cutting apparatus taken at a position in which the cutteredge is ground.
Figure 4:
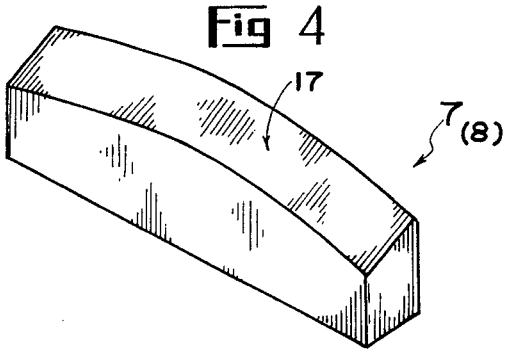
FIG. 4 is a perspective view of conventionally used grindstone.
Figure 5:
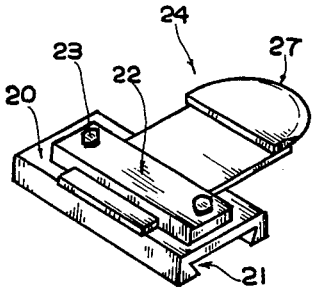
FIG. 5 a perspective view of a slider provided with a cutter as a first embodiment of the present invention.
Figure 6:
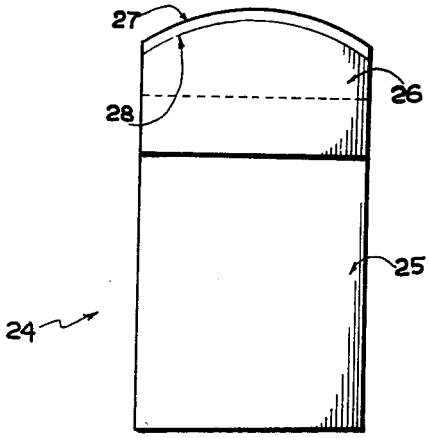
FIG. 6 is a plan view of the cutter.
Figure 7:
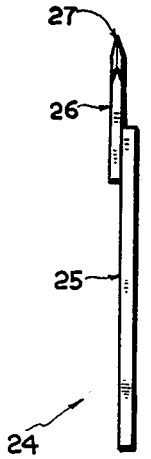
FIG. 7 is a side view of the cutter.

FIGS. 5, 6, and 7 show a cutter 24 used in the first embodiment of the present invention. The reference numeral 20 indicates a slider provided with a dovetail groove 21 at the reverse side, and rotatably fitted onto the rail to be driven weftwise by the revolving drum through the rope.

The numeral 22 denotes a pressing plate fixed to the slider 20 with screws 23. The cutter 24 is clamped between the pressing plate 22 and the slider 20.

The cutter 24 is composed of a metal plate 25 and a 0.4 mm thick single crystal sapphire sheet 26. The single crystal sapphire cutting sheet 26 is bonded to the front side of the metal plate 25 with resin. The projecting end 28 of the cutting sheet 26 is in the shape of an arc and provided with an edge having an angle of 17° in the symmetrical configuration between the obverse and the reverse sides of the sheet.

For bonding the cutting sheet 26 to the metal plate 25, thermosetting resin such as epoxy resin or silver solder, which is free of rubber-like elasticity, is used.

The cutter 24 may be made up not only by bonding a cutting sheet 26 to a metal plate 25 as described above but also by composing a cutting sheet in one body includng a part corresponding to the metal plate 25.

Figure 8:
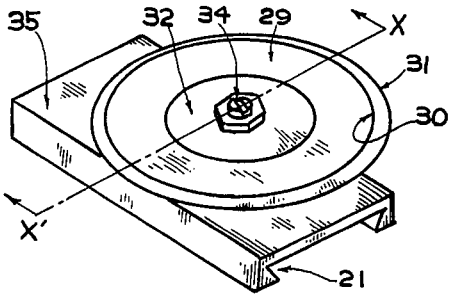
FIG. 8 is a perspective view of a slider provided with a cutter as a second embodiment of the present invention.
Figure 9:
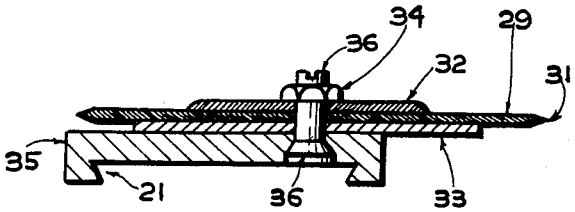
FIG. 9 is a sectional view of the slider taken along the line X—X' in FIG. 8.

FIG. 8 and FIG. 9 show a cutter used in a second embodiment of the present invention. The cutter 29 is a 0.4 mm thick disk made of single crystal sapphire and periphery 30 thereof is shaped into a cross-sectionally symmetrical cutting edge 31 having an angle of 17°. The cutter 29 is provided with a hole for a screw at the center thereof and fixed to the slider 35 with a nut 34 through washers 32 and 33.

The reference numeral 36 denotes a flat head screw to be screwed into the slider from the reverse side and idly inserted through the hole of the cutter 29. Therefore, the cutter edge 31 can be angularly shifted right and left by turning the cutter 29 after the nut 34 is loosened.

When using the cutter 24 having the edge cut away at both shoulder parts thereof and made arcuate at the front end, yarns are cut at approximately the same points on the edge during reciprocation of the cutter, whereby the cutter edge 27 is partially worn out and caused to lose cutting characteristic thereat.

However, the cutter 29 used in the second embodiment as shown in FIGS. 8 and 9 is circular, that is, a disk of a fixed diameter. Therefore, as far as the cutting sheet has an edge angle as described above (7° to 25°), even when cutting characteristic of a part of the edge is reduced, cutting is made possible by a slight turn of the cutter with the nut 34 and screw 36 loosened and by adapting another part of the cutter edge to touch the pile yarn. Thus, one piece of cutter 29 can be used dozens of times without being replaced or ground.

In conclusion, effects of the present invention are summarized as follows:

(1) The cutter edge is highly resistant to wear and the cutting characteristic is maintained for a long term. As a result, stoppage of the double-pile loom for grinding or adjusting the cutter and grindstones is not required, thereby significantly improving operation efficiency of the double-pile loom and enabling automation in weaving of the pile fabric.

(2) No adjustment is required in fixing the cutter and the grindstone, thus special skill is not required. Also the double-pile loom can be operated similarly to ordinary looms such as a plain loom.

(3) Deviation of the cutter position resulting from wear of the cutter edge is eliminated, that is, a distance e between the cloth fell and the cutter edge does not change, whereby simultaneous cutting of two or more rows of pile yarns lined weftwise possibly caused immediately after replacement of cutters is prevented. Thus, clumsy yarn cutting following the replacement of cutters never occurs.

(4) A pile length difference between the top and the bottom sheets of fabric is prevented from being caused by a burr, or backward or upward reflection of the cutter edge, whereby allowance of the pile yarn length prepared for weaving in consideration of poor cutting become unnecessary and the loss of pile yarns is entirely prevented, enabling saving of material cost in pile making.

(5) The cutter smoothly slides and is free of up-and-down vibration during running. The quantity of waste piles (minute chips) is minimized and brushing (removal of minute chips) prior to shearing is simplified since few minute chips stick to the pile-covered surface.

(6) Clumsy yarn cutting occurs far less frequently and shearing is simpified to a degree that only floating yarns are cut and removed, thereby reducing shearing frequency and raising efficiency in the finishing operation.

In this way, according to the present invention, productivity in weaving of the pile fabric is markedly raised. Particularly, shearing loss that has so far reached 39% of consumption of pile yarns is significantly reduced. The present invention, therefore, is very beneficial for cost saving in the production of pile fabric.

We claim:

1. A cutter for use in a double-pile loom not having a grindstone to grind the cutter edge wherein;

said cutter edge of said cutter is of single crystal sapphire sheet; and said cutter edge is formed in the shape of an arc and provided with an edge having an angle in the range of 7°–27° in a symmetrical configuration between obverse and reverse side of a projecting end of said single crystal sapphire sheet.

2. The cutter according to claim 1, wherein said single crystal sapphire sheet has thickness of less than 1.0 mm, and has a specific gravity of 3.97, Vickers hardness number of 2,300 kg/mm$^2$, bending strength of 7,000 kg/cm$^2$, compression strength of 30,000 kg/cm$^2$, Young's modulus of 4,800,000 kg/cm$^2$, specific heat of 0.18 cal/g ° C.; and said cutter edge is formed in the shape of an arc and provided with an edge having an angle in the range of 11°–23° in a symmetrical configuration between obverse and reverse sides of a projecting end of said single crystal sapphire sheet.

3. The cutter according to claim 2 wherein said single crystal sapphire sheet has a thickness of 0.4 mm.

4. The cutter according to claim 3 wherein said single crystal sapphire sheet is bonded to the front side of the metal plate with a substantially non-elastic resin.

5. The cutter according to claim 4, wherein said resin is selected from the group consisting of epoxy resin and silver solder.

6. The cutter according to claim 5, wherein said single crystal sapphire sheet is a 0.4 mm thick disk and a periphery thereof is shaped into a cross-sectionally symmetrical cutting edge and is provided with a hole for a screw at the center thereof to fix to a slider with a nut.

* * * * *